US009989878B2

(12) United States Patent
Ujike

(10) Patent No.: US 9,989,878 B2
(45) Date of Patent: Jun. 5, 2018

(54) IMAGE FORMING APPARATUS AND METHOD OF CONTROLLING THE SAME

(71) Applicant: Konica Minolta, Inc., Chiyoda-ku, Tokyo (JP)

(72) Inventor: Hiroyuki Ujike, Kokubunji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/257,631

(22) Filed: Sep. 6, 2016

(65) Prior Publication Data

US 2017/0068196 A1 Mar. 9, 2017

(30) Foreign Application Priority Data

Sep. 8, 2015 (JP) ..... 2015-176418

(51) Int. Cl.
*G03G 15/00* (2006.01)
*G03G 15/01* (2006.01)

(52) U.S. Cl.
CPC ..... *G03G 15/0189* (2013.01); *G03G 15/55* (2013.01); *G03G 15/6517* (2013.01); *G03G 2215/00569* (2013.01)

(58) Field of Classification Search
None
See application file for complete search history.

(56) References Cited

U.S. PATENT DOCUMENTS

2011/0249992 A1 10/2011 Yoshida
2013/0194590 A1* 8/2013 Takeishi ..... G06F 3/1212 358/1.2
2013/0202338 A1* 8/2013 Matsumoto ..... G03G 15/234 399/364

FOREIGN PATENT DOCUMENTS

JP 2001-066842 A 3/2001
JP 2003-063115 A 3/2003
JP 2008-109385 A 5/2008
JP 2011-232729 A 11/2011
JP 2012-185292 A 9/2012

OTHER PUBLICATIONS

Japanese Office Action dated Aug. 22, 2017 in corresponding Japanese Patent Application 2015-176418.

* cited by examiner

*Primary Examiner* — Sevan A Aydin
(74) *Attorney, Agent, or Firm* — Buchanan Ingersoll & Rooney PC

(57) ABSTRACT

An image forming apparatus is configured to change one of the expected adjustment timing and the expected switching timing so as to be matched with the other, to determine a timing for predetermined adjustment and switching of print modes.

16 Claims, 12 Drawing Sheets

IMAGE FORMING APPARATUS AND METHOD OF CONTROLLING THE SAME

This application is based on Japanese Patent Application No. 2015-176418 filed with the Japan Patent Office on Sep. 8, 2015, the entire content of which is hereby incorporated by reference.

BACKGROUND OF THE INVENTION

Field of the Invention

The present disclosure relates to an image forming apparatus and a method of controlling the same, and more particularly to an image forming apparatus that forms an image on continuous paper and a method of controlling the same.

Description of the Related Art

Image forming apparatuses that form not only monochrome images but also color images have been widespread. Some of such image forming apparatuses have an image forming unit controlled in respective print modes (monochrome mode, color mode) for monochrome images and color images. Some of such image forming apparatuses additionally include a special mode using special ink such as transparent ink and white ink in the print modes for controlling the image forming unit.

For example, Japanese Laid-Open Patent Publication No. 2012-185292 discloses control pertaining to improvement in problems caused by vibration in switching of print modes between the monochrome mode, the color mode, and the special mode (for example, avoiding image defects such as color registration errors and pitch irregularity).

Japanese Laid-Open Patent Publication No. 2011-232729 discloses a technique for reducing image errors during control for separation of materials (image carriers) from the transfer belt in connection with control mode switching between the monochrome mode, the color mode, and the special mode.

Japanese Laid-Open Patent Publication No. 2008-109385 discloses a technique in which when monochrome images and color images are mixed in an image to be formed, the monochrome image are printed in the monochrome print mode and the color images alone are additionally printed in the color print mode on the sheet already printed.

The image forming unit of the image forming apparatus as described above may include a plurality of image carriers for respective colors for forming images of colors different from each other. In such a case, the image carriers are in abutment with the transfer belts and worn due to friction or other reasons even in a period in which they are not used for image formation. In particular, when the image forming unit forms an image on continuous paper, maintenance including replacement of image carriers may not be conducted for a relatively long time. As the image carriers have worn out, defects such as degradation of the formed images may occur. A technique for suppressing wear of the image carriers is therefore required in image forming apparatuses.

Considering the above-mentioned prior an, there remains significant room for reducing wear of image carriers in image forming apparatuses.

SUMMARY OF THE INVENTION

According to an aspect of the present disclosure, an image forming apparatus includes an image forming unit configured to form an image on continuous paper and a control unit configured to control operation of the image forming unit.

The image forming unit includes a plurality of image carriers. The image carriers are configured to form toner images of respective colors different from each other. The control unit is configured to switch print modes in image forming operation, between a first mode in which a first number of image carriers among the plurality of image carriers is driven and a second mode in which a second number, smaller than the first number, of image carriers among the plurality of image carriers is driven. The control unit is configured to stop image forming operation of the image forming unit to execute predetermined adjustment when a predetermined adjustment condition is established, and to resume image forming operation of the image forming unit when the predetermined adjustment is completed. The control unit is configured to specify an expected adjustment timing, which defines a timing to start the predetermined adjustment, in accordance with the adjustment condition. The control unit is configured to specify an expected switching timing, which is a timing to switch the print modes, in accordance with one or more colors used in an image to be printed on continuous paper. The control unit is configured to change one of the expected adjustment timing and the expected switching timing so as to be matched with the other, to determine a timing for the predetermined adjustment and switching of the print modes.

According to another aspect of the present disclosure, a method of controlling an image forming apparatus is provided. The image forming apparatus includes an image forming unit configured to form an image on continuous paper. The image forming unit includes a plurality of image carriers for forming toner images of colors different from each other. The method includes: switching print modes in image forming operation between a first mode in which a first number of image carriers among the image carriers is driven and a second mode in which a second number, smaller than the first number, of image carriers among the image carriers is driven; executing predetermined adjustment, with the image forming unit allowed to stop image forming operation, when a predetermined adjustment condition is established; allowing the image forming unit to resume image forming operation when the predetermined adjustment is completed; specifying an expected adjustment timing, which is a timing to execute the predetermined adjustment, in accordance with the adjustment condition; specifying an expected switching timing, which is a timing to switch the print modes, in accordance with a color used in an image to be printed on continuous paper; and changing one of the expected adjustment timing and the expected switching timing so as to be matched with the other. The predetermined adjustment and switching of the print modes are executed at a timing specified by the expected adjustment timing and the expected switching timing.

The foregoing and other objects, features, aspects and advantages of the present invention wilt become more apparent from the following detailed description of the present invention when taken in conjunction with the accompanying drawings.

DESCRIPTION OF THE PREFERRED EMBODIMENTS

Embodiments of an image forming apparatus will be described below with reference to the drawings. In the following description, the same parts and components are denoted with the same reference signs. Their names and functions are also the same. A detailed description thereof will therefore not be repeated.

First Embodiment

<1. Overview>

Figure 1:
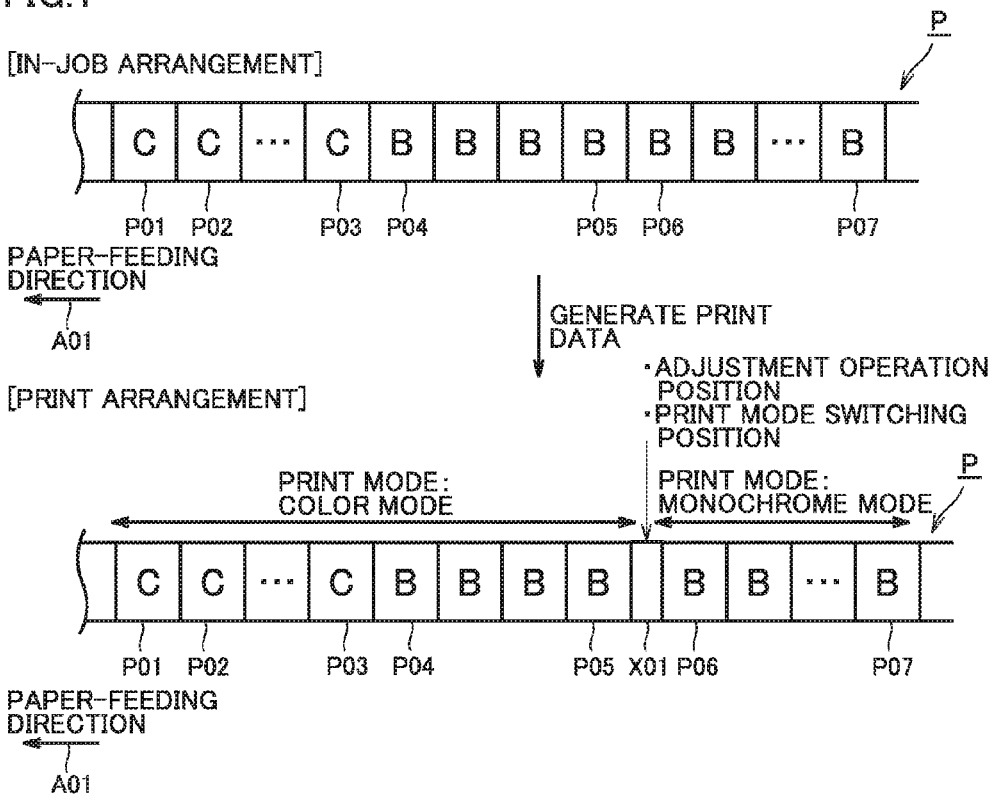
FIG. 1 is a diagram schematically illustrating arrangement of an image formed on continuous paper.

An image forming apparatus of a first embodiment of the present disclosure forms an image on continuous paper. In the image forming apparatus of the first embodiment, switching of print modes and adjustment operation are performed on the same position on continuous paper. This will be described below with reference to the drawings. FIG. 1 is a diagram schematically illustrating arrangement of an image formed on continuous paper.

FIG. 1 shows [print arrangement] and [in-job arrangement] as for the arrangement of an image on continuous paper P. [Print arrangement] schematically shows the arrangement of an image supposed to be actually printed on continuous paper P. [In-job arrangement] schematically shows the arrangement of an image in a print job to be printed. That is, the image arranged as shown in [in-job arrangement] in the received job is adjusted by the image forming apparatus and thereby printed in such an arrangement as shown in [print arrangement] on continuous paper P. In FIG. 1, the arrow A01 shows the feeding direction of continuous paper P. [Print arrangement] and [in-job arrangement] include a plurality of sections, such as sections P01, P02 . . . P03, P04 . . . P05, P06 . . . P07. Each section corresponds to, for example, the image of one page in a print job.

[Print arrangement] includes section X01. Section X01 shows a position on continuous paper P that corresponds to a timing when the adjustment processing of the image forming apparatus and the switching of print modes are performed. In FIG. 1, the "print mode switching position" indicates a position corresponding to switching of print modes. The "adjustment operation position" indicates a position corresponding to a timing when the adjustment operation is performed.

Here, the "switching of print modes" will be described.

The image forming apparatus includes four image carriers corresponding to Y (yellow), M (magenta), C (cyan), and BK (black). The image forming apparatus have, for example, two print modes (color mode and monochrome mode) for the four image carriers. In the color mode, all the four image carriers are driven to rotate for transferring a toner image. In the monochrome mode, the image carrier of BK alone is driven to rotate for transferring a toner image. The image forming apparatus switches a print mode between these two modes.

Next, the "adjustment operation" will be described.

In the image forming apparatus, when a predetermined adjustment condition is established, the adjustment operation (for example, "image stabilizing control" described later) is executed. An example of the adjustment condition is that image formation of a certain length (for example, 500 meters) is performed on continuous paper. That is, in this example, every time image formation of 300 meters is performed, the adjustment condition is established and the adjustment operation is executed. The "adjustment operation" will be further described later with reference to FIG. 2.

In the image forming apparatus of the first embodiment, when the switching of print modes and the adjustment operation are executed during execution of a job, the timing of one of them is matched with the timing of the other.

Here, the characters such as "C" and "B" in section P01 and others in FIG. 1 will be described. "C" or "B" in each section represents the kind of color information of each page. The print job includes color information for each page. The color information includes, for example, "color page" indicating that image formation requires multiple colors and "monochrome page" indicating that image formation requires ink of a single color. In FIG. 1, "C" represents the color information "color page", and "B" represents "monochrome page".

The relation between the switching of color information of pages to be printed and the setting of print modes in [print arrangement] in FIG. 1 will be described. As shown in [print arrangement] in FIG. 1, the color information of the image on continuous paper P switches to "monochrome page" in section P04 after "color page" in section P03. On the other hand, in [print arrangement], the print mode is switched from "color mode" to "monochrome mode" after the switching of color information, that is, after printing of section P05. This is partly for the purpose of maintaining periodicity in the image formed on continuous paper P. That is, for example, in the image forming apparatus, when the step of cutting paper having images formed thereon is executed after the image forming step, it is preferable that images are arranged at regular intervals on continuous paper in order to accurately cut the continuous paper at a relative position to the formed images.

The permissible amount for the periodicity to be maintained (that is, the permissible amount of displacement in images printed on continuous paper) is specified based on the specifics of the post-processing step in the image forming apparatus. For example, when the image forming apparatus includes a laser cutter as an example of the post-processing device that processes the continuous paper after image formation, and the laser cutter cuts the continuous paper while recognizing the images formed on the continuous paper, the permissible amount may be relatively large. This is because even when displacement occurs in print, the laser cutter can adjust the cut position in accordance with the displacement. On the other hand, when the post-processing step includes cutting a preset part, for example, with a guillotine cutter as another example of the post-processing device, the permissible amount may be relatively small.

<2. Configuration of Image Forming Apparatus>

Figure 2:
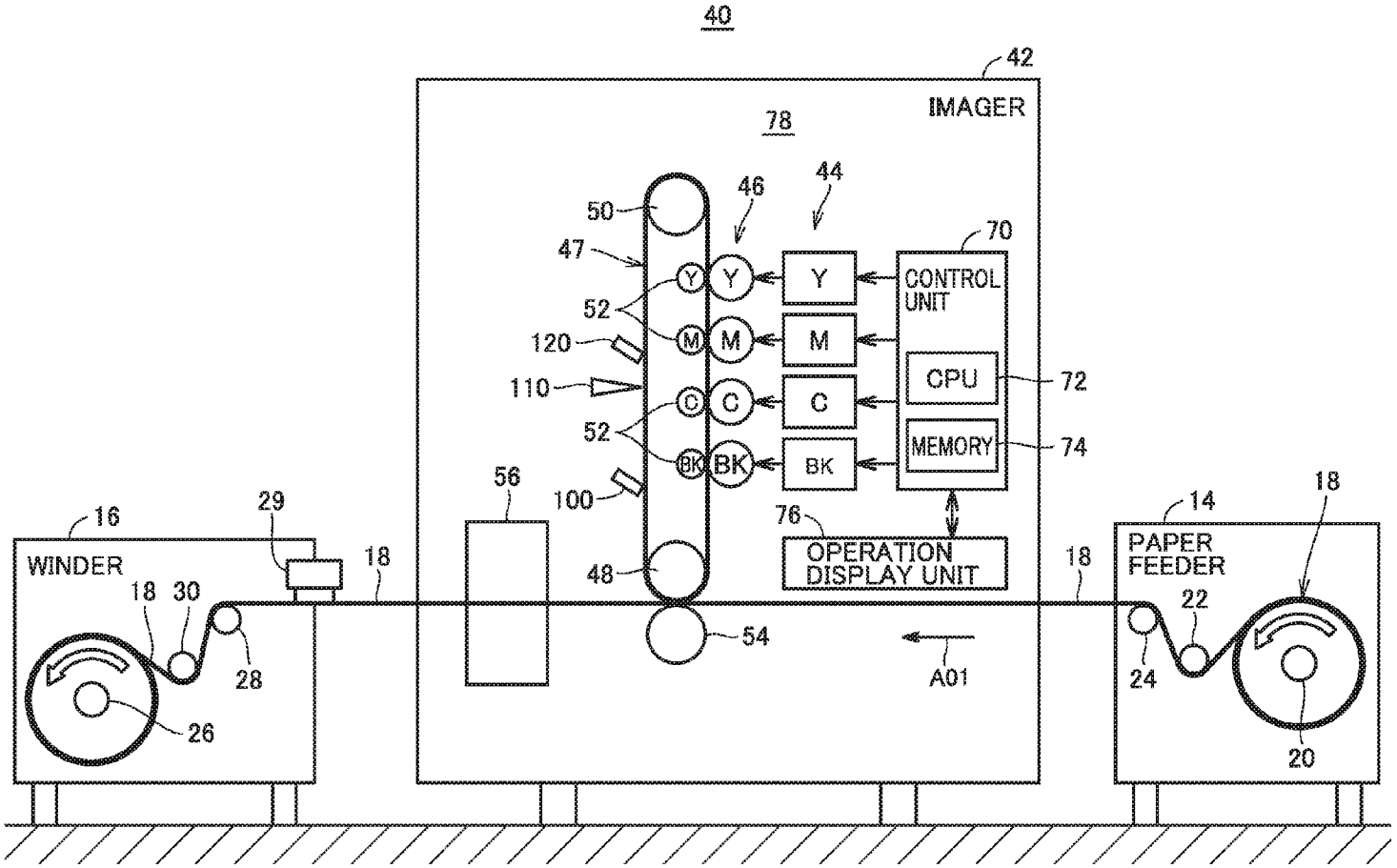
FIG. 2 is a diagram illustrating a schematic configuration of an image forming system as an exemplary image forming apparatus.

In the first embodiment, an image forming system 40 is employed as an embodiment of the image forming apparatus. FIG. 2 is a diagram illustrating a schematic configuration of image forming system 40 as an example of the image forming apparatus.

As shown in FIG. 2, image forming system 40 includes a paper feeder 14, an imager 42, and a winder 16. The arrow A01 in FIG. 2 denotes the feeding direction of continuous paper 18.

Paper feeder 14 for continuous paper 18 is provided upstream of imager 42. Winder 16 is provided as a paper receiver downstream of imager 42. Paper feeder 14 includes a receiving shaft 20 for continuous paper 18, and tension and guide rollers 22 and 24.

Imager 42 includes a plurality of imaging units in the case of an electrophotography system.

Specifically, imager 42 includes four imaging units of yellow (Y), magenta (M), cyan (C), and black (BK). The four imaging units hereinafter may be collectively referred to as imaging unit 44. The four imaging units each include a photoconductor drum 46 and a not-shown development mechanism including toner, developer, and electrodes.

Imager 42 includes a not-shown rotating mechanism for driving the four imaging units and a not-shown coupling mechanism for coupling each of the four imaging units to the rotating mechanism. Each imaging unit may be mechanically coupled to the rotating mechanism by the coupling mechanism. Each imaging unit is rotated by the rotating mechanism, whereby toner is conveyed to the developing unit in each imaging unit.

Imager 42 also includes a control unit 70 for controlling each imaging unit 44, an operation display unit 76, an intermediate transfer belt 47, rollers 48, 50, a secondary transfer roller 54, a fixing unit 56, a first cleaning member 100, a detection sensor 110, and a second cleaning member 120.

Control unit 70 includes a CPU (Central Processing Unit) 72 and a memory 74, and those components are mutually connected via a bus. CPU 72 is, for example, a microprocessor, a microcomputer, or an application specific integrated circuit. Memory 74 includes a hard disk, a read only memory (ROM), and a random access memory (RAM). This memory 74 stores an operating system such as Windows® and a program controlling the operation of image forming system 40 and also operates as a temporary storage device.

In control unit 70, an input/output (I/O) device (not shown) is connected to a bus. Control unit 70 receives external image data and status data representing the states of fixing unit 56 and image forming unit 78 in imager 42 through this I/O device.

Operation display unit 76 includes operation switches (or keyboard) and a display and is configured to allow the operator to perform control operation for imager 42 and the like. Operation display unit 76 may be a touch panel-type operation unit mounted on imager 42 or may be a computer input device. Control unit 70 controls the operation of fixing unit 56 and image forming unit 78 in accordance with the above-noted program and instruction data from operation display unit 76. This program also includes a program for imaging operation according to the present disclosure as described later.

The exposure unit scans photoconductor drums 46 charged by chargers with laser light to form electrostatic latent images, based on Y, M, C and BK image signals supplied from control unit 70.

Intermediate transfer belt 47 is stretched between rollers 48 and 50.

Primary transfer rollers 52 (in FIG. 2, one primary transfer roller 52 is provided for each of four colors Y, M, C, BK) are disposed to be opposed to the photoconductor drums 46 of Y, M, C, BK with intermediate transfer belt 47 interposed. Four primary transfer rollers 52 electrostatically attract toner images formed on the respective surfaces of four photoconductor drums 46 to transfer the toner images onto intermediate transfer belt 47 (primary transfer).

The toner image on intermediate transfer belt 47 is transferred to continuous paper 18 sandwiched between roller 48 and secondary transfer roller 54 (secondary transfer).

The toner image transferred on continuous paper 18 is fixed by fixing unit 56 on continuous paper 18, thereby completing imaging (image formation).

Imaging unit 44, photoconductor drum 46, intermediate transfer belt 47, secondary transfer roller 54, and the like constitute an image forming unit 78.

Winder 16 includes a spool shaft 26 for continuous paper 18, and tension and guide rollers 28 and 30.

Image forming unit 78 performs imaging, that is, printing on continuous paper 18 in accordance with an instruction from control unit 70.

First cleaning member 100 removes toner residue after transfer of the toner image on intermediate transfer belt 47. Second cleaning member 120 removes adhesive such as glue adhering to intermediate transfer belt 47.

Detection sensor 110 detects adhesive such as glue adhering to intermediate transfer belt 47. A diode may be used as detection sensor 110 for detection based on a change in the amount of receiving light with respect to light emission (change in reflectivity). For example, a line sensor such as a CIS (Contact Image Sensor) may be used. A laser displacement meter for detecting the amount of adhesion (height) of adhesive such as glue may be used as detection sensor 110. The sensor is not limited to those examples, and any other system may be used for detection. When a predetermined height is detected, it may be determined that adhesive adheres.

When a toner image is formed on continuous paper 18 as tack paper, continuous paper 18 is pressed from above and below between secondary transfer roller 54 and roller 48, for example, at a transfer position, whereby adhesive such as glue may be squeezed from continuous paper 18 at the end portions of continuous paper 18. The squeezed adhesive such as glue may adhere to intermediate transfer bell 47. If the adhesive is left, toner adheres to the adhesive to reduce the cleaning performance of first cleaning member 100, possibly resulting in image defects such as lines and variable density.

In the configuration according to the first embodiment, besides first cleaning member 100, second cleaning member 120 is provided on intermediate transfer belt 47 to remove adhesive such as glue adhering to intermediate transfer belt 47. Second cleaning member 120 provided to properly remove the adhesive on intermediate transfer belt 47 increases the cleaning performance of the first cleaning member to suppress image defects such as lines and variable density.

Winder 16 includes a cutter 29 as an example of the post-processing device. Cutter 29 cuts the continuous paper output from imager 42 as appropriate in accordance with an instruction from control unit 70.

The adjustment operation as described above will now be described.

The adjustment operation includes cleaning of the transfer belts, removal of toner left on the photoconductors, and image stabilizing control. For example, the image stabilizing control adjusts image forming conditions (including charging voltage, amount of exposure, and development bias voltage) such that the density of an image formed by the image forming apparatus attains a target density.

More specifically, the image stabilizing control, for example, forms an image adjustment pattern image on an image carrier such as intermediate transfer belt 47 or a recording medium such as paper, detects the density of the formed image adjustment pattern image with a detection unit, and feeds the detection result back to the image forming conditions such that the detection result is reflected in the image forming conditions.

<3. Process Flow>

Figure 3:
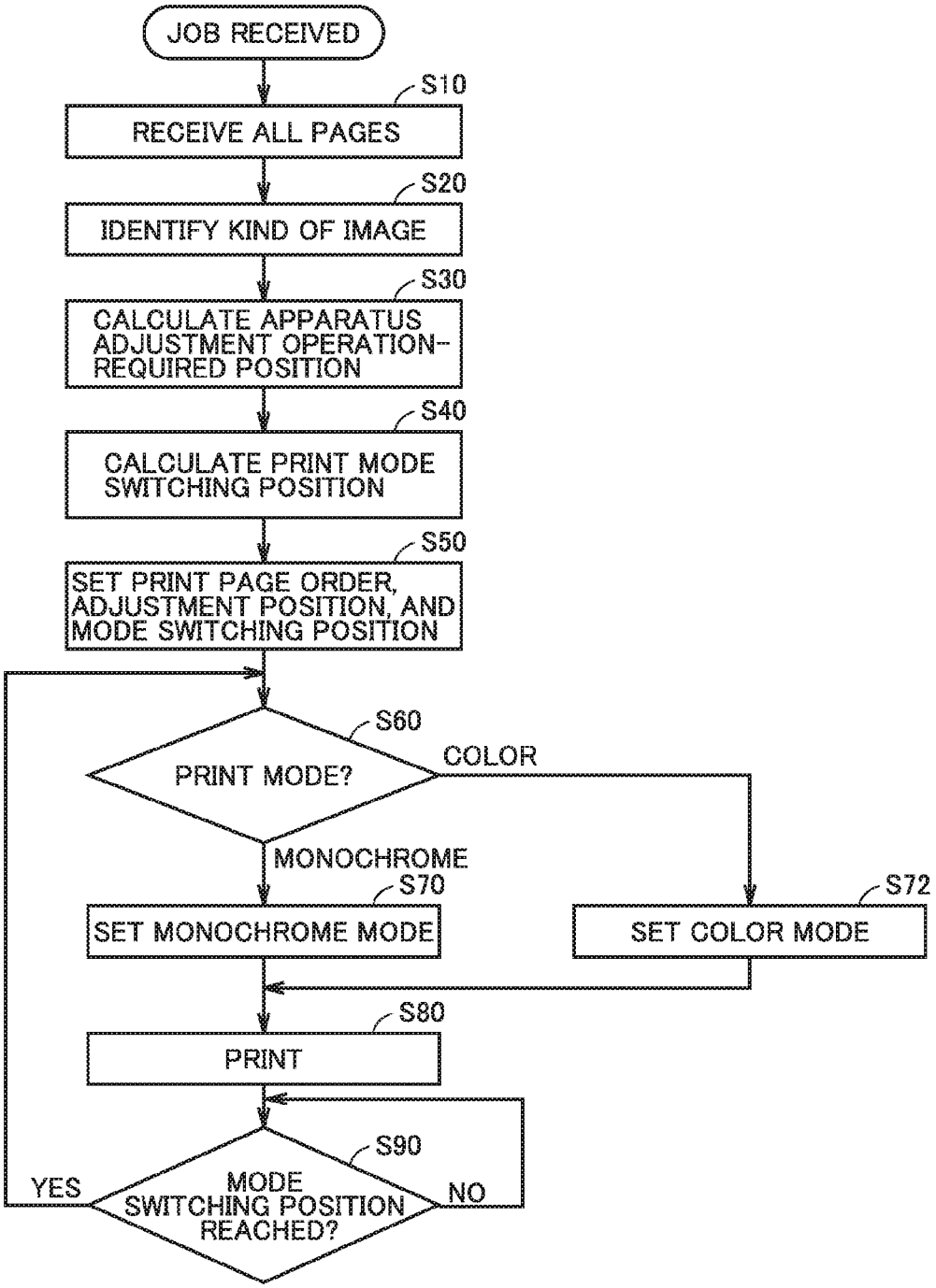
FIG. 3 is a flowchart of an example of the processing executed when the image forming system receives a print job for image formation.

FIG. 3 is a flowchart of an example of the processing executed when image forming system 40 receives a print job for image formation from another device through a network or the like.

In the processing in FIG. 3, in addition to an adjustment operation position and a print mode switching position described with reference to FIG. 1, an "expected adjustment position", which is a position where the adjustment operation is to be executed, and an "expected mode switching position", which is a position where switching of print modes is to be executed, are calculated. The "adjustment operation position" and the "print mode switching position" are then set based on the "expected adjustment position" and the "expected mode switching position".

Referring to FIG. 3, at step S10, CPU 72 receives all the pages in a job. The control then proceeds to step S20.

At step S20, CPU 72 identities the kind of image of each page of the received job. The kind of image is identified, for example, based on the above-noted color information. The control then proceeds to step S30.

At step S30, CPU 72 calculates (specifies) the "expected adjustment position". The control then proceeds to step S40.

An example of the "expected adjustment position" is a position in continuous paper a predetermined length (for example, 300 meters) away from the position between rollers 48 and 50 when the previous adjustment operation is performed. In this example, the timing when the expected adjustment position is supposed to be located between rollers 48 and 50 is the expected adjustment timing. The position on the continuous paper corresponding to the timing is specified, for example, using the rotation speed of spool shaft 26 in winder 16.

Another example of the "expected adjustment position" is a position on continuous paper that is supposed to be located between rollers 48 and 50 when image formation is performed for a specific time since the point of time when the previous adjustment operation is performed. This is a position on continuous paper corresponding to the timing.

At step S40, CPU 72 specifies a position in continuous paper at which a print mode is to be switched (expected mode switching position) during execution of the received job.

The "expected mode switching position" is a position at which color information is switched (from color page to monochrome page, or from monochrome page to color page), for example, when pages to be printed by a job are arranged in the feeding direction of continuous paper, More specifically, the "expected mode switching position" is a position of switching between "C" and "B" in a plurality of sections arranged in [in-job arrangement] in FIG. 1. The control then proceeds to step S50.

At step S50, CPU 72 sets the order in which pages are printed (print page order), the position at which the adjustment operation is to be executed (adjustment operation position), and the position at which print modes are switched (print mode switching position), for the received job. The "adjustment operation position" and the "print mode switching position" are set, for example, as positions on continuous paper. In the present embodiment, the "adjustment operation position" is the same position as the "expected adjustment position" at step S30. The "print mode switching position" is a position such that the "expected mode switching position" at step S40 is changed so as to be matched with the "expected adjustment position".

The control then proceeds to step S60.

At step S60, CPU 72 specifies a print mode to be set. If it is determined that a print mode to be set is the monochrome mode, the control proceeds to step S70. If it is determined that a print mode to be set is the color mode, the control proceeds to step S72.

At step S70, CPU 72 switches the print mode to the monochrome mode. In the monochrome mode, among four imaging units in imaging unit 44, the imaging unit (BK) alone is mechanically coupled to the rotating mechanism. The control then proceeds to step S80.

At step S72. CPU 72 switches the print mode to the color mode. In the color mode, four imaging units (Y, M, C, BK) in imaging unit 44 are mechanically coupled to the rotating mechanic. The control then proceeds to step S80.

At step S80, CPU 72 starts (resumes) printing of the job (image formation) in the print mode switched at step S70 or step S72. The control then proceeds to step S90.

At step S90, CPU 72 determines whether the mode switching position in continuous paper reaches rollers 48, 50. CPU 72 keeps the control at step S90 until the mode switching position reaches rollers 48, 50, and if determining that it reaches, returns the control to step S60.

CPU 72 continues the processing in FIG. 3 until the printing of the print job is completed.

In the processing described above with reference to FIG. 3, CPU 72 switches print modes when the print mode switching position on continuous paper reaches rollers 48, 50. The print mode switching position is set so as to be matched with the expected adjustment position. When the continuous paper subjected to a print job includes a plurality of print mode switching positions and one expected adjustment position, one of the print mode switching positions is matched with the one expected adjustment position (adjustment operation position). As used herein "matched" includes that a period of time required for the adjustment operation at least partially overlaps a period of time required for the switching of print modes.

Alternatively, the switching of print modes and the adjustment operation may be started at a timing when a predetermined position on continuous paper is supposed to reach rollers 48, 50, in place of the timing when a predetermined position on continuous paper (print mode switching position, adjustment operation position) reaches rollers 48, 50.

<4. Specific Example of Image Printed on Continuous Paper>

Figure 4:
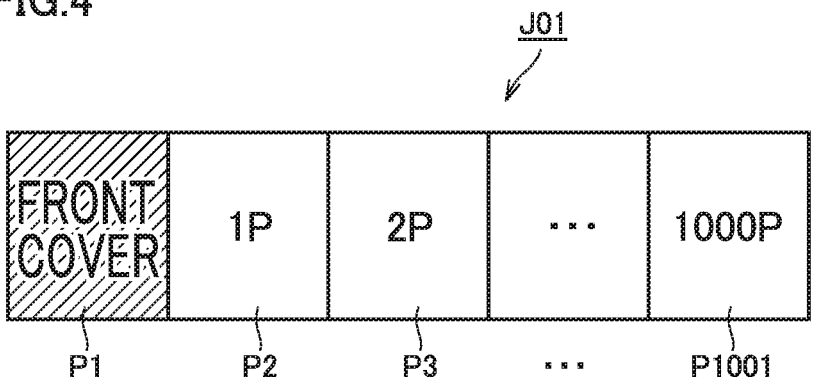
FIGS. 4 and 5 are diagrams showing a specific example of an image in which color pages and monochrome pages are mixed to be printed on continuous paper.
Figure 5:
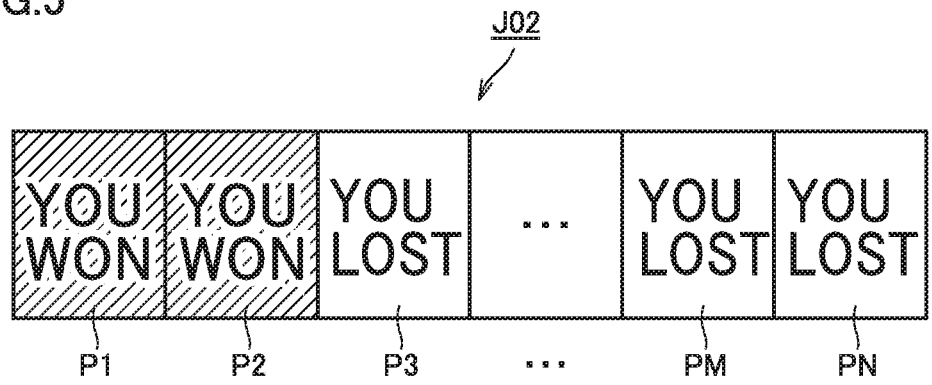

FIG. 4 and FIG. 5 are diagrams showing specific examples of an image in which color pages and monochrome pages are mixed to be printed on continuous paper by the image forming apparatus of the first embodiment (image forming system 40).

The image shown in FIG. 4 includes section P1 that forms a front cover and section P2, P3 . . . P1001 that form pages in a print material such as a book. In the example in FIG. 4, the color information of section P1 is "color page". The color information of sections P2, P3 . . . P1001 is "monochrome page". In the example in FIG. 4, the pages illustrated as sections P2, P3 . . . P1001 are provided so as to be bound together.

The image shown in FIG. 5 includes a plurality of pages that may be distributed as a print material including independent pages. More specifically, the image shown in FIG. 5 includes N sections denoted as sections P1, P2, P3, . . . PM, PN, and those sections are provided so as to be separate from each other. Each section forms a single lottery ticket. In the example in FIG. 5, the color information of sections P1, P2 is "color page". The color information of sections P3 to PN is "monochrome page".

In the first embodiment described above, the color mode of the print modes is an example of the first mode in which a first number of image carriers is driven. The monochrome mode is an example of the second mode in which a second number, smaller than the first number, of image carriers is driven.

Second Embodiment

Figure 6:
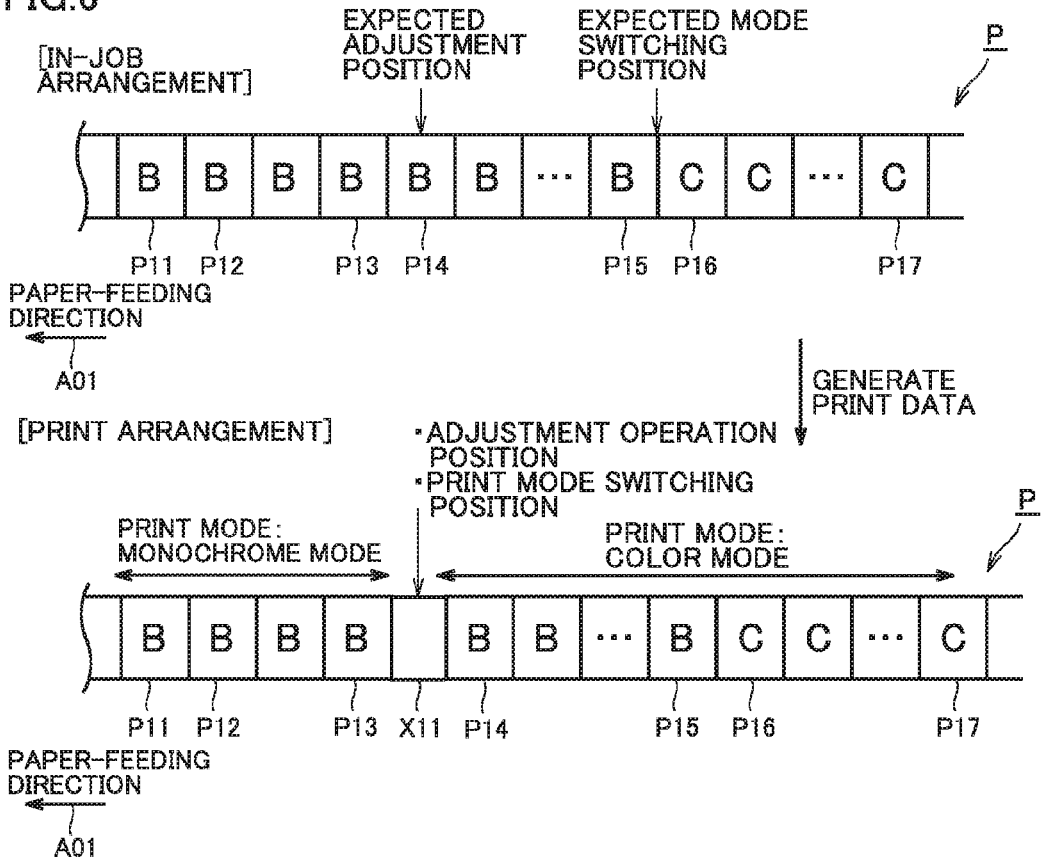
FIG. 6 is a diagram illustrating an example of an image formed on continuous paper by the image forming apparatus of a second embodiment.

FIG. 6 is a diagram illustrating an example of an image formed on continuous paper by the image forming apparatus of a second embodiment. The arrow A01 in FIG. 6 indicates the feeding direction of continuous paper P.

FIG. 6, similar to FIG. 1, shows [print arrangement] and [in-job arrangement] for an image formed on continuous paper P. FIG. 6 also shows individual pages of the formed image, such as sections P11, P12, . . . P13, P14, . . . P15, P16, . . . P17 . . . on continuous paper P. Such a page layout is defined, for example, in a print job received by image forming system 40.

In FIG. 6, similar to FIG. 1, a page denoted as "B" is a page having color information of "monochrome page". A page denoted as "C" is a page having color information of "color page".

As shown in [print arrangement] and [in-job arrangement] in FIG. 6, in the example in FIG. 6, the monochrome pages denoted as sections P11 to P15 are printed prior to the color pages denoted as sections P16 to P17.

In the example in FIG. 6, as shown in [print arrangement] in FIG. 6, the adjustment operation is executed when printing of section P13 is finished. The period of time in which the adjustment operation is executed is denoted as section X11.

In the example in FIG. 6, the print modes are switched at this section X11. In the example in FIG. 6, since the monochrome pages are printed first and the color pages are thereafter printed, the switching of print modes is switching from the monochrome mode to the color mode.

Third Embodiment

Figure 7:
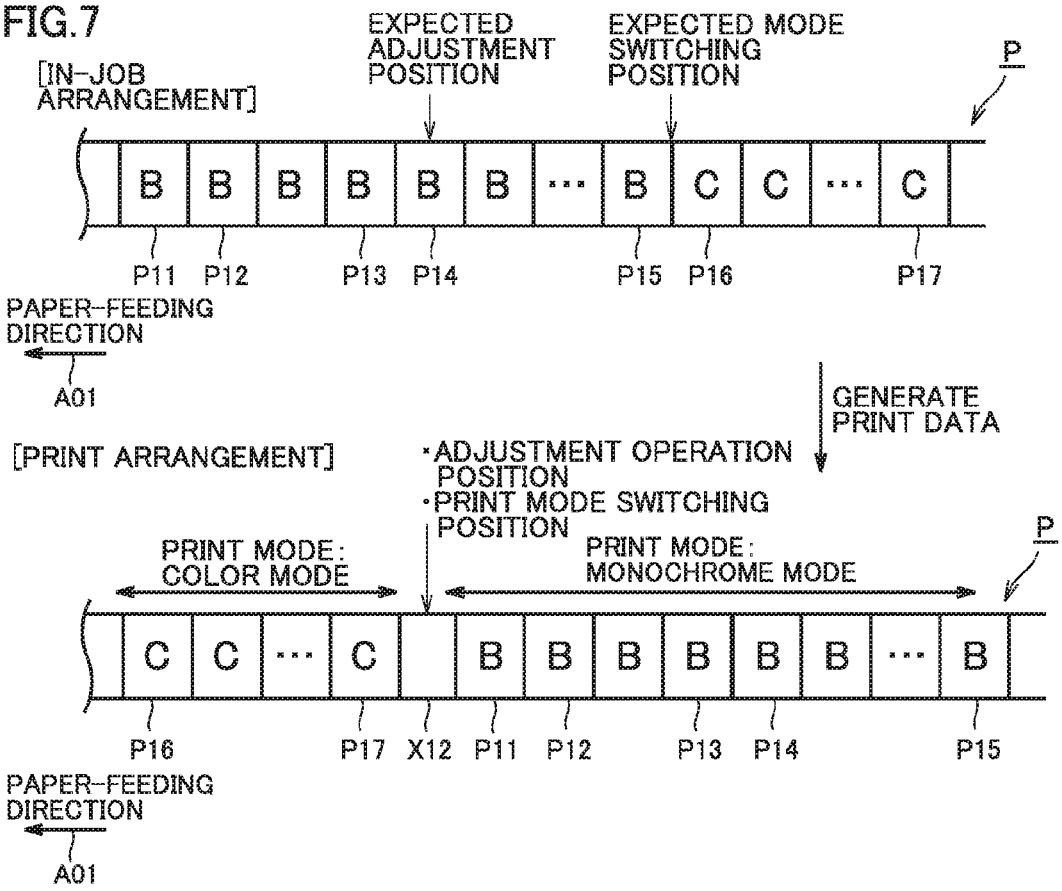
FIG. 7 is a diagram illustrating a change in page arrangement in a third embodiment.

Image forming system 40 of a third embodiment generates [print arrangement] by changing page arrangement in a print job such that the switching of print modes is switching from the color mode to the monochrome mode. FIG. 7 is a diagram illustrating a change in page arrangement in the third embodiment.

FIG. 7, similar to FIG. 1, shows [print arrangement] and [in-job arrangement] for an image formed on continuous paper P. FIG. 7, similar to FIG. 6, shows individual pages of the formed image, such as sections P11, P12, . . . P13, P14, . . . P15, P16, . . . P17 . . . on continuous paper P.

Image forming system 40 of the third embodiment receives a print job in which monochrome pages are arranged prior to color pages, similarly to the second embodiment, as shown in [in-job arrangement] in FIG. 7. Subsequently, if a certain condition is satisfied, image forming system 40 changes the arrangement of pages printed on continuous paper P, as shown in [print arrangement] in FIG. 7.

More specifically, in [in-job arrangement] in FIG. 7, the monochrome pages denoted as sections P11 to P15 are arranged so as to be printed prior to the color pages denoted as sections P16 to P17. On the other hand, in [print arrangement], the page arrangement is changed from the one shown in [in-job arrangement] such that the color pages denoted as sections P16 to P17 are printed prior to the monochrome pages denoted as sections P11 to P15.

In the example in FIG. 7, a print job is executed while the adjustment operation is executed at the "adjustment operation position" and the print mode is changed at the "print mode switching position". The position at which the adjustment operation and the switching of print modes are executed is denoted as section X12.

The length of section X12 in the paper-feeding direction in FIG. 7 may be shorter than section X11 in FIG. 6. This is because the number of image carriers used after changing the print mode is smaller in the example in FIG. 7 than in the example in FIG. 6.

That is, in the adjustment operation in FIG. 6, the number of image carriers used after the adjustment operation is "4" (C, Y, M, BK) due to the change in print mode, and therefore it is necessary to write four adjustment patches. On the other hand, in the adjustment operation in FIG. 7, the number of image carriers used after the adjustment operation is "1" (BK) due to the change in print mode, and therefore the number of adjustment patches to be written is "1". The difference in time required for execution of the switching of print modes and the adjustment operation includes such a difference in number of adjustment patches to be written.

Figure 8:
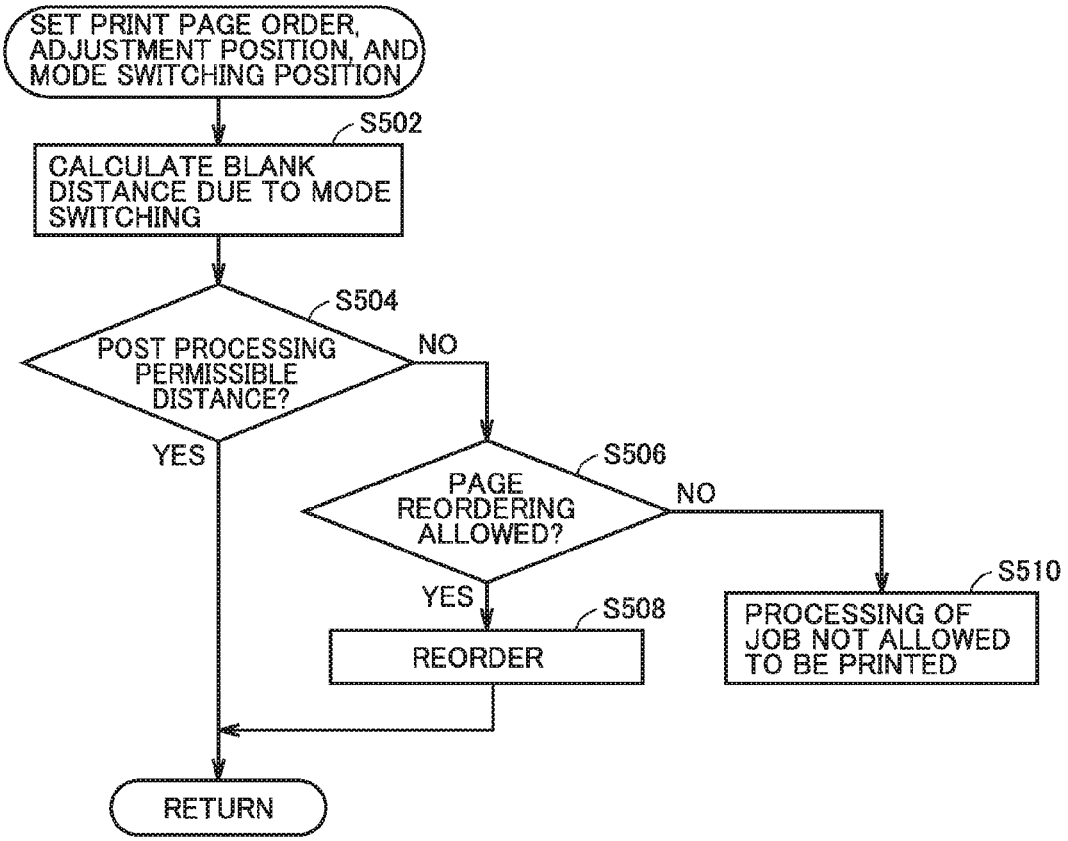
FIG. 8 is a diagram illustrating the processing executed in the third embodiment.

In the example shown in FIG. 7, it is preferable that whether to shuffle pages is determined considering a certain requirement. FIG. 8 is a diagram illustrating the processing executed in the third embodiment. The processing in FIG. 8 is executed, for example, after step S50 in the first embodiment illustrated in FIG. 3.

As shown in FIG. 3, after the expected adjustment position is specified at step S30, the expected mode switching position is specified at step S40, and the "adjustment operation position" and the "print mode switching position" are set at step S50, the control proceeds to step S502 in FIG. 8.

At step S502, CPU 72 calculates displacement of print (blank distance) that may occur if the print mode is switched at the "print mode switching position" set at step S50. The "blank distance" is, for example, the size of a part of continuous paper (section X12 in FIG. 7) in the paper-feeding direction that is sent during the adjustment operation and the switching of print modes. The control then proceeds to step S504.

At step S504, CPU 72 determines whether the blank distance calculated at step S502 is a range permissible in the post-processing step. CPU 72 temporarily generates [print arrangement], for example, as show in [print arrangement] in FIG. 7, in which the pages are reordered such that the color pages are printed prior to the monochrome pages, and makes a determination similar as in step S504 (whether it is permissible in the post-processing step) for the supposed blank distance in the temporarily created [print arrangement].

When the post-processing step includes cutting the continuous paper with a cutter, if the blank distance is equal to or smaller than a margin width set for the cutting with a cutter, the blank distance is determined to be permissible in the post-processing step. The post-processing step may include steps other than cutting with a cutter. The specifics of the determination at step S504 therefore may be changed depending on the specifics of the post-processing step.

If CPU 72 determines that the blank distance is a range permissible in the post-processing step at step S504, the process returns to FIG. 3. The control thus proceeds to step S60 (FIG. 3). On the other hand, if CPU 72 determines that the blank distance is not in a range permissible in the post-processing step, the control proceeds to step S506.

At step S506, CPU 72 determines whether the print job is a print job that allows page reordering. For example, when the print job relates to an image provided in a form of a plurality of pages bound together as shown in FIG. 4, it is determined that the page reordering is not allowed. This is because the formed image is provided in such a manner that reflects the page order. On the other hand, when a print material including printed sections independent from each other is distributed as shown in FIG. 5, it is determined that page reordering is allowed. For example, the print job includes tag information indicating whether the job is a job that allows page reordering.

If CPU 72 determines that the print job is a job that allows page reordering at step S506, the control proceeds to step S508. On the other hand, if CPU 72 determines that the print job is not a job trial allows page reordering, the control proceeds to step S510.

At step S508, CPU 72 generates print data by reordering the pages in the received job. In the generated print data, the page order is changed from [in-job arrangement] as shown in [print arrangement] in FIG. 7. The control then returns to FIG. 3. CPU 72 thus moves the control to step S60 in FIG. 3.

At step S510, CPU 72 executes the control indicating that the received print job is a job not allowed to be printed. Specifically, for example, CPU 72 displays that the received print job is a job not allowed to be printed, on operation display unit 76 (FIG. 2). At step S510, CPU 72 does not generate print data. The control subsequent to step S60 in FIG. 3 is thus not executed.

Fourth Embodiment

Figure 9:
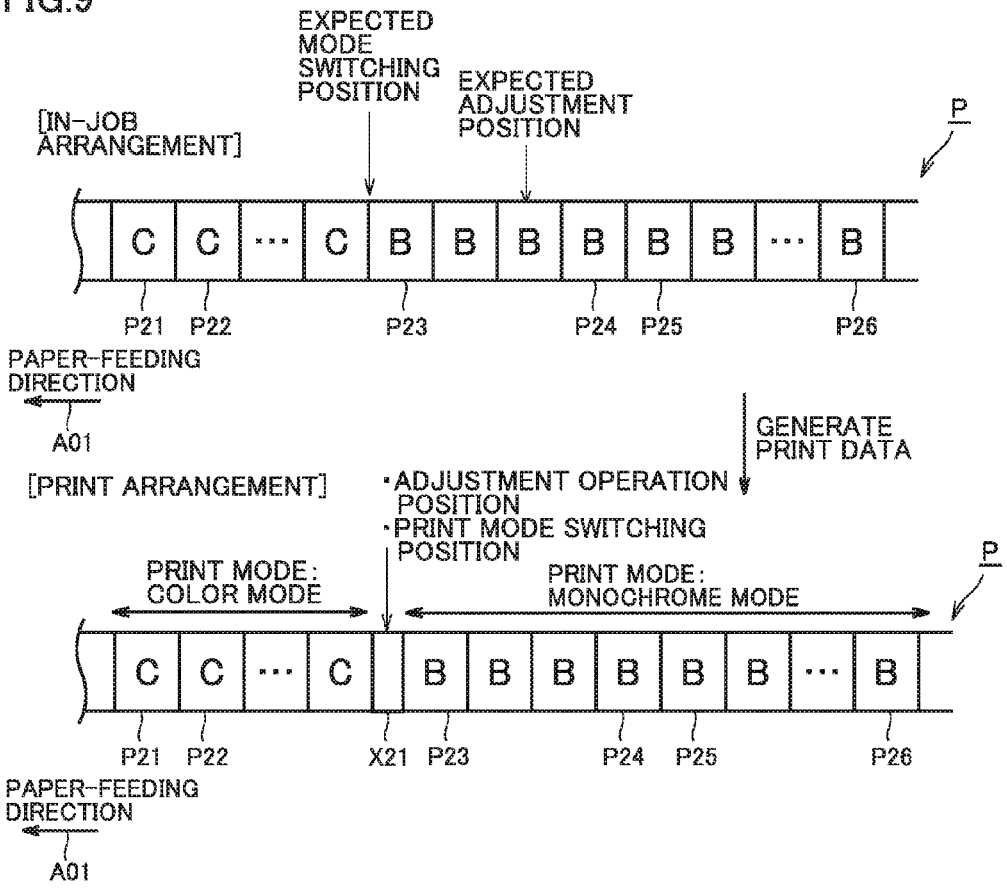
FIG. 9 is a diagram illustrating a manner of setting of the adjustment operation position and the print mode switching position in a fourth embodiment.

In image forming system 40 of a fourth embodiment, the adjustment operation position is set by changing the expected adjustment position so as to be matched with the print mode switching position. FIG. 9 is a diagram illustrating a manner of setting of the adjustment operation position and the print mode switching position in the fourth embodiment. FIG. 9 shows individual pages of the formed image, such as sections P21, P22, . . . P23 . . . P24, P25, . . . P26 on continuous paper P.

As shown in [in-job arrangement] in FIG. 9, the expected print mode switching position is located to precede the expected adjustment position (the upstream side in the paper-feeding direction, the left side in FIG. 9).

In such a case, in the fourth embodiment, the adjustment operation position is set by changing the expected adjustment position so as to be matched with the expected mode switching position. The print mode switching position is set by using the expected mode switching position unchanged.

Fifth Embodiment

Figure 10:
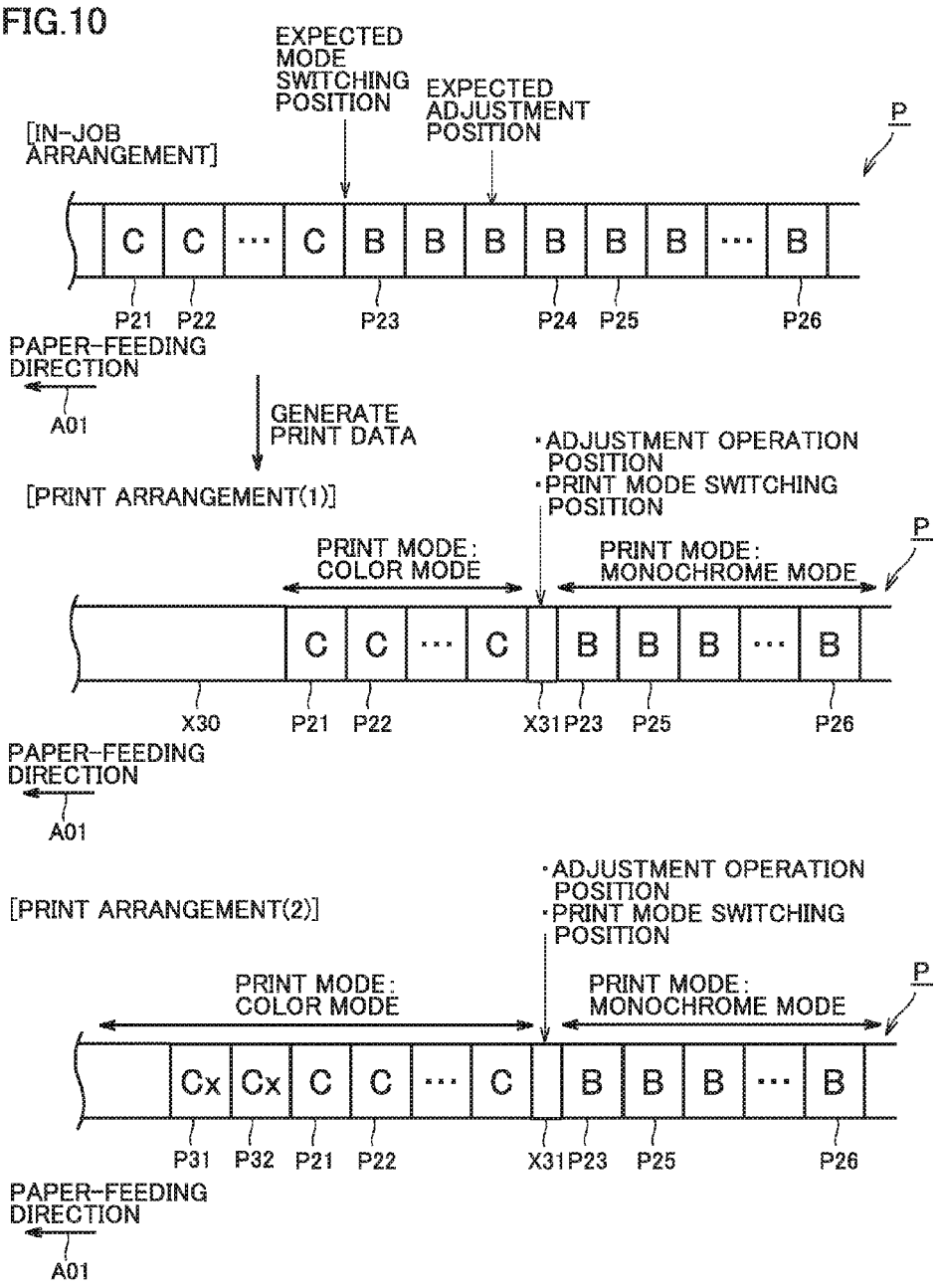
FIG. 10 is a diagram illustrating a manner of setting of the adjustment operation position and the print mode switching position in a fifth embodiment.

In image forming system 40 of a fifth embodiment, the position at which image formation is stalled on continuous paper is changed such that the expected print mode switching position is matched with the expected adjustment position. FIG. 10 is a diagram illustrating a manner of setting of the adjustment operation position and the print mode switching position in the fifth embodiment. FIG. 10, similar to FIG. 9, shows individual pages of the formed image, such as sections P21, P22, . . . P23 . . . P24, P25, . . . P26 . . . on continuous paper P.

As shown in [in-job arrangement] in FIG. 10, the expected mode switching position is located to precede the expected adjustment position (the upstream side in the paper-feeding direction). The expected mode switching position is specified based on the arrangement of the color pages ("C" in FIG. 10) and the monochrome pages ("B" in FIG. 10) in the printed image. More specifically, the expected mode switching position is set as a position at which a color page switches to a monochrome page or a position at which a monochrome page switches to a color page.

In [print arrangement (1)] in FIG. 10, the print mode switching position is set at a position where the start position of image formation on continuous paper P is changed backward such that the expected mode switching position matches the expected adjustment position (the downstream side in the paper-feeding direction), as denoted as section X31.

In continuous paper P in [print arrangement (1)], a region where no image is formed is produced, as denoted as a section X30 located prior to section P21, due to the backward shifting of the start position of image formation.

In image forming system 40 of the fifth embodiment, an image supposed to be formed further backward in the print job can be arranged at a part corresponding to section X30, as shown in [print arrangement (2)] in FIG. 10. In [print arrangement (2)] in FIG. 10, the image arranged in section X30 is denoted as sections P31, P32.

Figure 11:
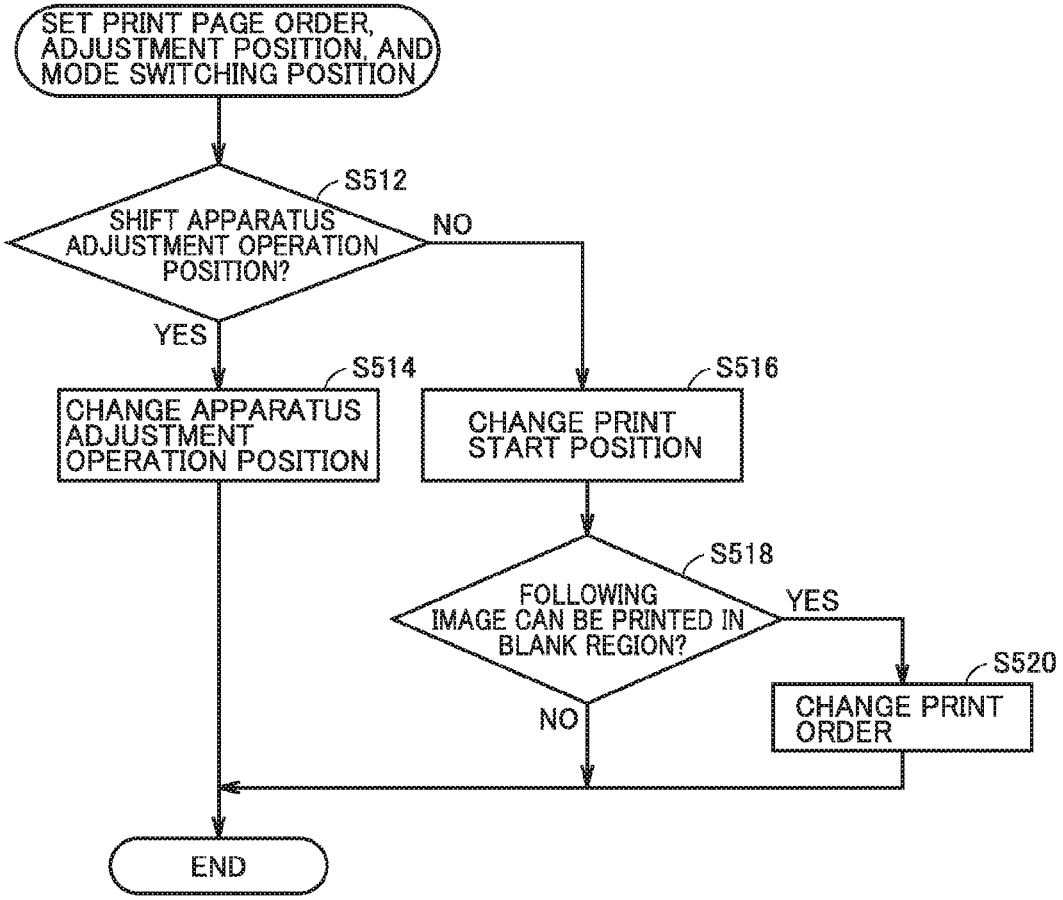
FIG. 11 is a diagram illustrating the processing executed in the fifth embodiment.

FIG. 11 is a diagram illustrating the processing executed in the fifth embodiment. The processing in FIG. 11 is executed, for example, after step S50 in the first embodiment shown in FIG. 3.

As shown in FIG. 3, after the expected adjustment position is specified at step S30, the expected mode switching position is specified at step S40, and the "adjustment operation position" and the "print mode switching position" are set at step S50, the control proceeds to step S512 in FIG. 11.

At step S512, CPU 72 determines whether the expected adjustment position specified at step S30 can be shifted so as to match the expected mode switching position specified at step S40. For example, at step S512, CPU 72 determines whether the expected mode switching position is located previous to the expected adjustment position (the same position or the upstream side in the paper-feeding direction on continuous paper). If CPU 72 determines that the expected mode switching position is located previous to the expected adjustment position, the control proceeds to step S514 to match the expected adjustment position with the expected mode switching position. On the other hand, if CPU 72 determines that the expected mode switching position is located backward of the expected adjustment position (the downstream side in the paper-feeding direction), the control proceeds to step S516, because the expected adjustment position cannot be matched with the expected mode switching position.

At step S514, CPU 72 resets the expected adjustment position by changing the expected adjustment position so as to be matched with the expected mode switching position as shown in [print arrangement] in FIG. 9 in the fourth embodiment. The control then returns to step S60 in FIG. 3.

At step S516, CPU 72 resets the expected mode switching position by changing the expected mode switching position so as to be matched with the expected adjustment position, as shown in [print arrangement (1)] in FIG. 10. The control then proceeds to step S518.

At step S518, CPU 72 determines whether the following image can be printed in the blank region (section X30 in [print arrangement (1)] in FIG. 10). An example of the following image that can be printed is an image that has color information common to the image to be printed immediately after the blank region (section P21 in [print arrangement (1)] in FIG. 10) and that has a length smaller than the size of the blank region in the paper-feeding direction. The "following" means subsequent to the adjustment operation position. The following image may be an image in the print job received at step S10 or an image of a print job different from the received print job.

At step S518, if CPU 72 determines that the following image can be printed, the control proceeds to step S520. On the other hand, if CPU 72 determines that the following image cannot be printed, the control returns to step S60 in FIG. 3.

At step S520, CPU 72 generates print data such that the order of images to be printed is changed as shown in [print arrangement (2)] in FIG. 10 CPU 72 then returns the control to step S60 in FIG. 3.

Image forming system 40 of the fifth embodiment executes printing such that the following image is arranged in a blank section as shown in [print arrangement (2)] in FIG. 10, thereby reducing a section sent to winder 16 without an image formed on continuous paper.

Sixth Embodiment

Image forming system 40 may include a special color mode using special color toner (white toner and/or transparent toner) as a print mode, in addition to the monochrome mode and the color mode. In this case, imager 42 of image forming system 40 further includes an imaging unit that carries an image of special color toner, in addition to four imaging units of yellow (Y), magenta (M), cyan (C), and black (BK).

In the color mode, four imaging units of yellow (Y), magenta (M), cyan (C), and black (BK) are coupled to the rotating mechanism, whereas in the special color mode, the imaging unit for special color toner is additionally coupled to the rotating mechanism.

Figure 12:
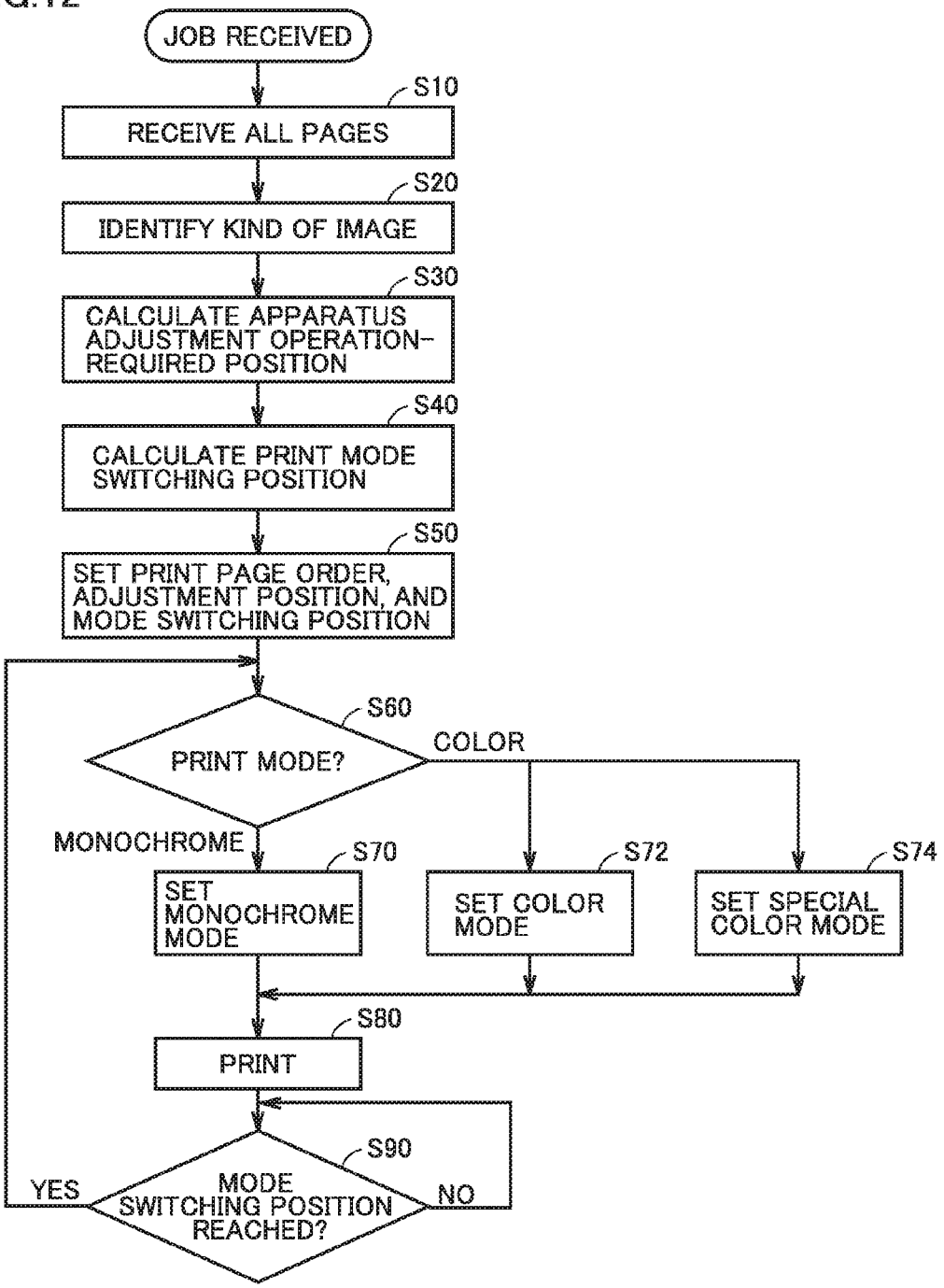
FIG. 12 is a flowchart of an example of the processing executed in a sixth embodiment.

In such a case, the processing in FIG. 3 may be changed as shown in FIG. 12.

That is, the control switched from step S60 includes the special color mode at step S74 in addition to the control in the monochrome mode at step S70 and the color mode at step S72.

If CPU 72 determines that the print mode to be set is the monochrome mode at step S60, the control proceeds to step S70. If CPU 72 determines that the print mode to be set is the color mode, the control proceeds to step S72. If CPU 72 determines that the print mode to be set is the special color mode, the control proceeds to step S74.

In the sixth embodiment described above, as for the print mode, the color mode is an example of the first mode in which a first number of image carriers is driven. The monochrome mode is an example of the second mode in which a second number, smaller than the first number, of image carriers is driven.

The special color mode is another example of the first mode in which a first number of image carriers is driven. The color mode is another example of the second mode in which a second number, smaller than the first number, of image carriers is driven.

According to the present disclosure, the image carriers fewer than in the first mode are driven in the second mode in the image forming unit. Accordingly, the number of image carriers driven is reduced in accordance with colors used in an image to be printed, thereby suppressing consumption of durables (for example, toner) due to driving of the image carriers. In addition, the timing of predetermined adjustment is matched with the timing of switching of print modes, thereby reducing a period of time in which the image formation operation should be stopped for predetermined adjustment and switching of print modes.

The embodiment disclosed here should be understood as being illustrative rather than being limitative in all respects. The scope of the present invention is shown not in the foregoing description but in the claims, and it is intended that all modifications that come within the meaning and range of equivalence to the claims are embraced here. The invention illustrated in the embodiments and modifications are intended to be carried out singly or in combination, wherever possible.

What is claimed is:

1. An image forming apparatus comprising:

an image forming unit configured to form an image on continuous paper; and a control unit configured to control operation of the image forming unit, the image forming unit including a plurality of image carriers, the image carriers being configured to form toner images of respective colors different from each other, wherein the control unit is configured to:

switch print modes in image forming operation, between a first mode in which a first number of image carriers among the plurality of image carriers is driven and a second mode in which a second number of image carriers among the plurality of image carriers is driven, the second number being smaller than the first number, stop image forming operation of the image forming unit to execute predetermined adjustment when a predetermined adjustment condition is established, and resume image forming operation of the image forming unit when the predetermined adjustment is completed, calculate at least one expected adjustment position based upon the predetermined adjustment condition, specify an expected adjustment timing in accordance with the at least one calculated expected adjustment position, the expected adjustment timing defining a timing to start the predetermined adjustment, calculate at least one expected mode switching position depending on one or more colors used in an image to be printed on continuous paper;

specify an expected switching timing depending on the at least one calculated expected mode switching position, the expected switching timing being a timing to switch the print modes, and change one of the expected adjustment timing and the expected switching timing so as to be matched with the other, to determine a timing for the predetermined adjustment and switching of the print modes.

2. The image forming apparatus according to claim 1, wherein the control unit is configured to change one of the expected adjustment timing and the expected switching timing by changing the expected switching timing so as to be matched with the expected adjustment timing.

3. The image forming apparatus according to claim 2, wherein an image to be printed on continuous paper includes a plurality of pages, and the control unit is configured to change order in which the pages are printed such that switching of the print modes in any pages of the pages includes switching from the first mode to the second mode.

4. The image forming apparatus according to claim 1, wherein the control unit is configured to change one of the expected adjustment timing and the expected switching timing by changing the expected adjustment timing so as to be matched with the expected switching timing.

5. The image forming apparatus according to claim 1, wherein an image to be printed on continuous page includes a plurality of pages, and changing one of the expected adjustment timing and the expected switching timing includes changing a print position of at least a part of the pages on continuous paper for matching the expected switching timing with the expected adjustment timing.

6. The image forming apparatus according to claim 5, wherein the control unit is further configured to change print order of the pages so as to fill in a blank region produced by changing the print position.

7. The image forming apparatus according to claim 1, wherein at least once during an execution of a print job, the predetermined adjustment and switching of the print modes occurs at an at least partially overlapping period of time.

8. The image forming according to claim 1, wherein one of the predetermined adjustment and switching of the print modes is performed a greater number of times during a given time period during than the other.

9. A method of controlling an image forming apparatus, the image forming apparatus including an image forming unit configured to form an image on continuous paper, the image forming unit including a plurality of image carriers for forming toner images of respective colors different from each other, the method comprising:

switching print modes in image forming operation between a first mode in which a first number of image carriers among the plurality of image carriers is driven and a second mode in which a second number of image carriers among the plurality of image carriers is driven, the second number being smaller than the first number;

executing predetermined adjustment, with the image forming unit allowed to stop image forming operation, when a predetermined adjustment condition is established;

allowing the image forming unit to resume image forming operation when the predetermined adjustment is completed;

calculating at least one expected adjustment position based upon the predetermined adjustment condition;

specifying an expected adjustment timing in accordance with the at least one calculated expected adjustment position, the expected adjustment timing defining a timing to start the predetermined adjustment;

calculating at least one expected mode switching position depending on one or more colors used in an image to be printed on continuous paper;

specifying an expected switching timing depending on the at least one calculated expected mode switching position, the expected switching timing being a timing to switch the print modes; and changing one of the expected adjustment timing and the expected switching timing so as to be matched with the other to determine a timing for the predetermined adjustment and switching of the print modes.

10. The method according to claim 9, wherein changing one of the expected adjustment timing and the expected switching timing includes changing the expected switching timing so as to be matched with the expected adjustment timing.

11. The method according to claim 10, wherein an image to be printed on continuous paper includes a plurality of pages, and switching of the print modes in any pages in the pages includes switching from the first mode to the second mode due to changing print order of the pages.

12. The method according to claim 10, wherein changing one of the expected adjustment timing and the expected switching timing includes changing the expected adjustment timing so as to be matched with the expected switching timing.

13. The method according to claim 10, wherein an image to be printed on continuous paper includes a plurality of pages, and changing one of the expected adjustment timing and the expected switching timing includes changing a print position of at least a part of the pages on continuous page for matching the expected switching timing with the expected adjustment timing.

14. The method according to claim 13, further comprising changing print order of the pages so as to fill in a blank region produced by changing the print position.

15. The method according to claim 9, wherein at least once during an execution of a print job, the predetermined adjustment and switching of the print modes occurs at an at least partially overlapping period of time.

16. The method according to claim 9, wherein one of the predetermined adjustment and switching of the print modes is performed a greater number of times during a given time period than the other.

* * * * *